United States Patent [19]

McJunkin, Jr. et al.

[11] 4,247,884

[45] Jan. 27, 1981

[54] FLUORESCENT MINE LIGHTING FIXTURE

[75] Inventors: H. P. McJunkin, Jr., Charleston; L. W. Rowley, Sissonville, both of W. Va.

[73] Assignee: McJunkin Corporation, Charleston, W. Va.

[21] Appl. No.: 736,204

[22] Filed: Oct. 27, 1976

[51] Int. Cl.[3] ..... F21L 23/00; F21S 3/00

[52] U.S. Cl. ..... 362/164; 362/217; 362/223; 362/260

[58] Field of Search ..... 240/51.11 R, 18; 362/164, 217, 223, 260

[56] References Cited

U.S. PATENT DOCUMENTS

| | | | |
|---|---|---|---|
| 3,136,489 | 6/1964 | Oharenko | 240/51.11 R X |
| 3,805,053 | 4/1974 | Julinot | 240/51.11 R |
| 3,808,495 | 4/1974 | Win | 240/51.11 R |
| 4,042,819 | 8/1977 | Dacal | 240/51.11 R |

*Primary Examiner*—Donald P. Walsh

*Attorney, Agent, or Firm*—Cushman, Darby & Cushman

[57] ABSTRACT

The fixture includes a mount assembly preferably including a cage. A lamp/bar assembly slides longitudinally into the mount assembly cage. The power cable of the lamp/bar assembly extends through a packing end cap. A transparent/translucent shatterproof plastic lamp tube protector sleeve is threadably secured to the packing end cap and encloses the lamp/bar assembly. When the packing end cap engages the cage and the protector sleeve is inside the cage, an inspection end cap is threadably secured on the opposite end of the protector sleeve. Thus, the protected lamp/bar assembly. The lamp may be replaced by removing the inspection end cap. Should there be an explosion within the fixture, heat will be dissipated as the expanding gases pass out of the fixture through the threading between the protector sleeve and end caps. The lamp/bar assembly is secured at a selected angle about the longitudinal axis of the mount assembly, between the two end caps. Elastomeric members mechanically isolate the lamp from the lamp holders, the lamp bar assembly from the end caps and the end caps from the mount assembly. The lamp holders, reflector, ballast and starter may be mounted on the lamp bar.

10 Claims, 6 Drawing Figures

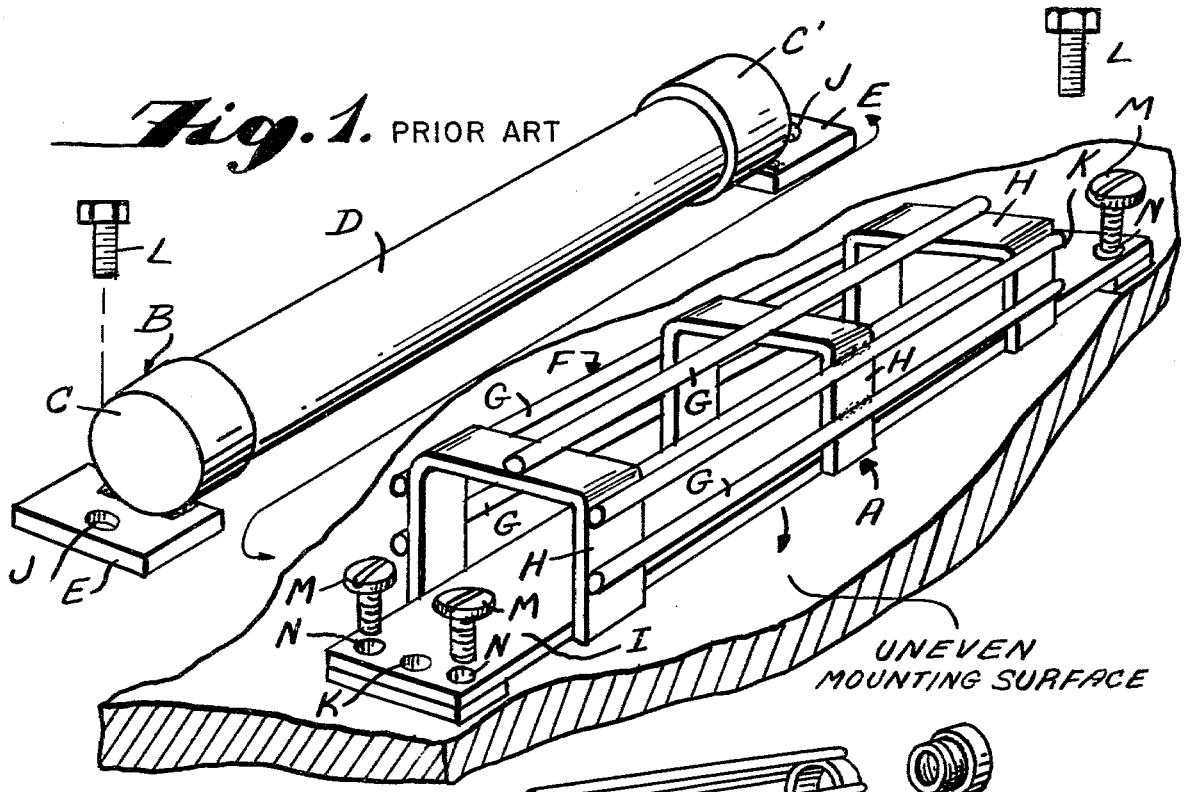
Fig. 1. PRIOR ART
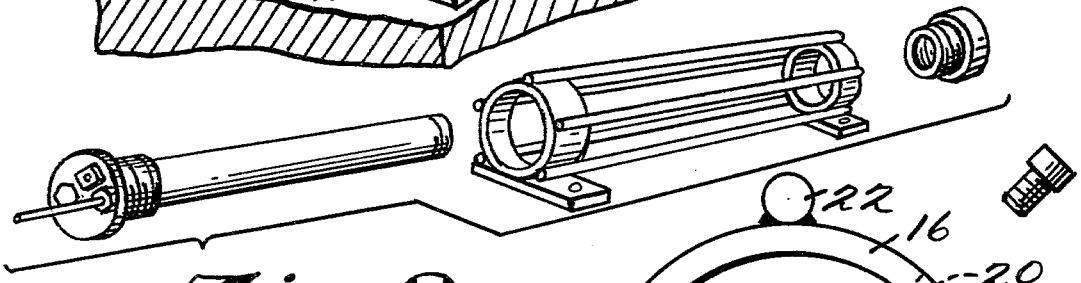
Fig. 2.
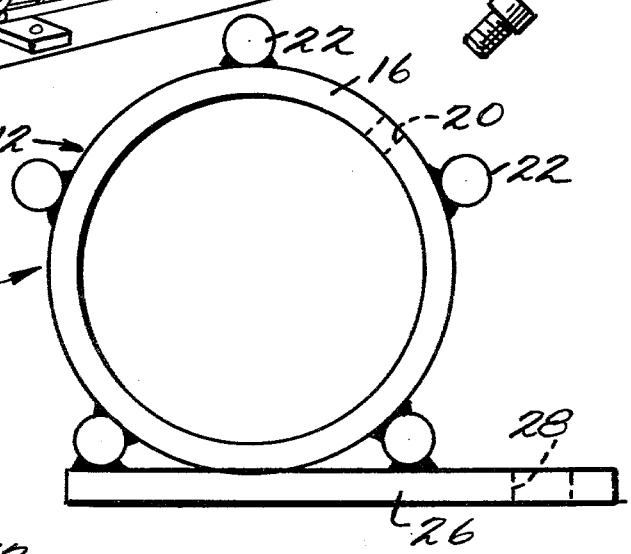
Fig. 4.
Fig. 5.
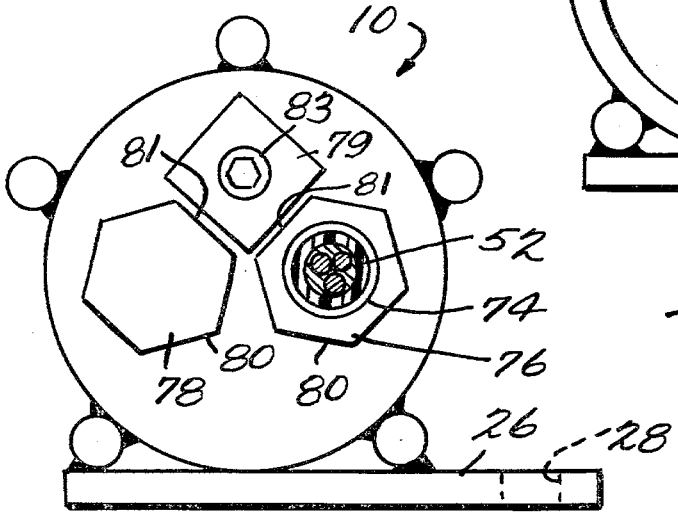

FLUORESCENT MINE LIGHTING FIXTURE

BACKGROUND OF THE INVENTION

The state of the art of underground mine lighting devices is reviewed in the August 1974 issue of *COAL AGE* magazine, on pages 66–74, in an article by its senior editor, Nicholas P. Chironis, entitled "Underground mine lighting . . . A look at what's new in concepts and equipment".

Briefly, Federal legislation dating from 1969 has set minimum lighting standards for mines. To meet the standards, alot of mine lighting devices are needed. Four main types of mine lighting are competing for the market: fluorescent, sodium vapor, mercury vapor and incandescent, each type having a distinct range of uses for which it is more ideal. Some devices are made to mount on miner's caps, others variously on mine roofs, walls and the like, on portable stands or on mining machinery such as continuous miners, loading machines, cutting machines and roof bolting machines.

The present invention relates to those of the fluorescent type.

Present manufacturers of fluorescent type mine lighting devices include Control Products, Inc., of Beckley, West Virginia, and Ocean Energy, Inc., of Blairsville, Pennsylvania.

During the course of the preparation of this document, the present inventors have become aware of the following prior United States patents showing lighting devices.

| Patentee | U.S. Pat. No. | Issue Date |
|---|---|---|
| Lester | 2,794,113 | May 28, 1957 |
| Williams | 2,807,710 | September 24, 1957 |
| Green | 2,888,657 | May 26, 1959 |
| Oharenko | 3,136,489 | June 9, 1964 |
| Oharenko | 3,140,054 | July 7, 1964 |
| Hayasaka et al. | 3,426,234 | February 4, 1969 |
| Phlieger, Jr. | 3,564,234 | February 16, 1971 |

SUMMARY OF THE INVENTION

The present invention provides a fluorescent mine lighting fixture.

The fixture includes a mount assembly preferably including a cage. A lamp/bar assembly slides longitudinally into the mount assembly cage. The power cable of the lamp/bar assembly extends through a packing end cap. A transparent/translucent shatterproof plastic lamp tube protector sleeve is threadably secured to the packing end cap and encloses the lamp/bar assembly. When the packing end cap engages the cage and the protector sleeve is inside the cage, an inspection end cap is threadably secured on the opposite end of the protector sleeve. Thus, the protected lamp/bar assembly. The lamp may be replaced by removing the inspection end cap. Should there be an explosion within the fixture, heat will be dissipated as the expanding gases pass out of the fixture through the threading between the protector sleeve and end caps. The lamp/bar assembly is secured at a selected angle about the longitudinal axis of the mount assembly, between the two end caps. Elastomeric members mechanically isolate the lamp from the lamp holders, the lamp bar assembly from the end caps and the end caps from the mount assembly. The lamp holders, reflector, ballast and starter may be mounted on the lamp bar.

Of course, the same fixtures could be used to advantage elsewhere: in caverns, in underground governmental installations such as hardened missile silos, command posts maintained as alternate facilities in case of disaster, in pipe trenches and utility tunnels beneath buildings, sidewalks and streets, and for general industrial use. It is most likely the fixtures will be used where it is expected explosive atmospheres will exist.

The principles of the invention will be further discussed with reference to the drawings wherein a preferred embodiment is shown. The specifics illustrated in the drawings are intended to exemplify, rather than limit, aspects of the invention as defined in the claims.

BRIEF DESCRIPTION OF THE DRAWING

In the Drawing

FIG. 1 is a schematic exploded perspective view of a presently commercially available prior art device;

FIG. 2 is a schematic exploded perspective view; and

FIG. 4 is a packing end elevation view of the device of FIGS. 2 and 3;

FIG. 5 is an end elevation view of a typical mount assembly of the device.

DESCRIPTION OF THE PRIOR ART DEVICE OF FIG. 1

Figures 3, 6:
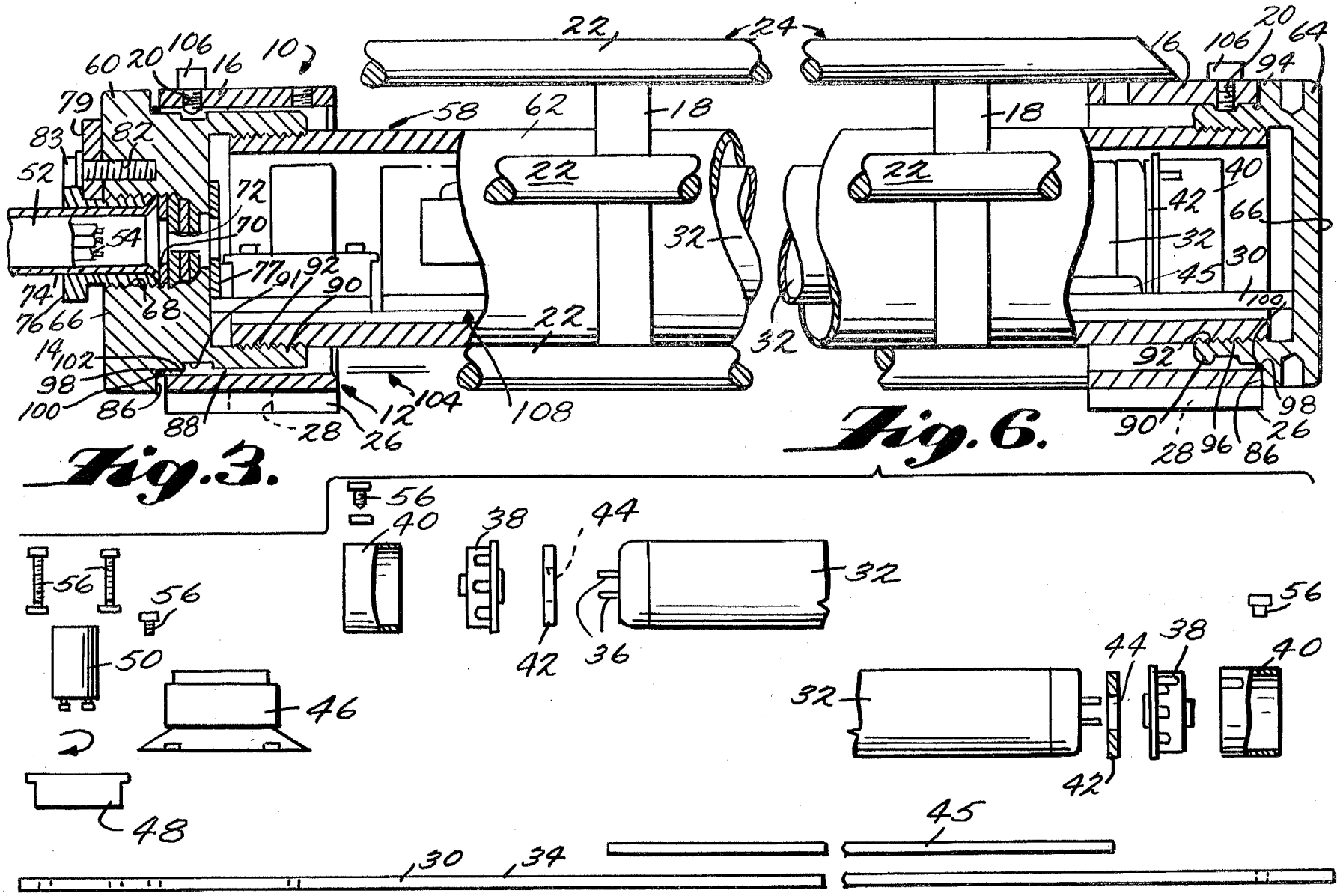
FIG. 3 is a side elevation view, partly in section of a fluorescent mine lighting fixture constructed in accordance with a preferred practice of the principles of the present invention.
FIG. 6 is an exploded perspective view of the lamp/-bar assembly of the device.

In FIG. 1, the prior art fluorescent mine lighting device includes a cage/mount assembly A and a lamp-/mount assembly B which includes end caps C including lamp holders for the opposite end portions of a fluorescent lamp tube assembly D. The caps C each include a foot E.

The cage/mount assembly A includes a generally tubular cage F fabricated on rods G, rod supports H and a backing plate I.

The lamp/mount assembly B is assembled to the cage/mount assembly A, by slipping the former into the latter until the foot E holes J align with the backing plate I tapped center holes K align. Bolts L are installed through the aligned openings J, K to secure the device together. Bolts M are installed through the backing plate I holes N to secure the device to a mine wall or the like or to mining machinery or the like.

Note that if the backing plate I is mounted by bolts M against an uneven surface with sufficient tightness to tend to distort its flatness, the tendency to torsion and or bending is transmitted via the feed E to the lamp holders C and lamp tube D. That may cause cracking, breaking, leakage, excessive wear and like adverse results. Further, mechanical shocks from sharp blows or concussions are often transmitted in the same way from the cage/mount assembly to the lamp tube, tending to produce the same adverse results. In short, there is generally poor mechanical isolation of the lamp from the cage/mount assembly. Installation, service and adjustability are relatively involved, difficult and non-existant, respectively.

DETAILED DESCRIPTION OF THE PRESENTLY PREFERRED EMBODIMENT

The fluorescent mine lighting fixture 10 (FIGS. 2 and 3) includes two major assemblies: a mount assembly 12 (FIGS. 4 and 5) and a lamp/bar assembly 14 (FIGS. 3 and 6).

In the instance shown, the mount assembly 12 includes two coaxial, longitudinally spaced tubular end supports 16 and additional tubular supports 18 spaced longitudinally between the end supports 16. The number of supports 18 needed is dependent upon the degree of ruggedness required and the length of the support assembly 12. Fluorescent lamp tubes are made in different lengths. Fixtures 10 for longer lamp tubes generally need more intermediate supports 18 than do fixtures 10 for shorter lamp tubes. The supports 16 each have tapped radially-directed openings 20. A plurality of parallel, equiangularly spaced rods 22 are welded to the outsides of the tubular supports 16, 18 to fabricate a cage 24. At one angular position on the cage, bar feet 26 are placed tangent to the respective supports 16 and two angularly adjacent rods 22 and welded thereto. The bar feet 26 have openings 28 through the thickness thereof, by the use of which the mount assembly may be bolted to a mine wall or other mine structure, or to mining machinery or the like. (In some instances, the bars 22 and intermediate supports 18 may be omitted, and the mount assembly then be constituted by the two supports 16 and respective bar feet 26.)

The lamp/bar assembly 14 includes a mounting bar 30 in the form of a long and narrow plate that is several inches longer than the lamp tube which it will carry. A fluorescent lamp tube 32 is longitudinally aligned with the mounting bar 30 and placed adjacent one face 34 thereof nearer one end of the bar. The lamp tube 32 has standard electrical contact pins 36 projecting axially from each end. A pair of opposing lamp holders 38 are mounted in respective tubular housings 40 which are in turn secured to the bar 30. Elastomeric washer-like bushings 42 having openings 44 are slipped over the pins 36 at both ends of the lamp tube 32 and the lamp tube is plugged into both lamp holders 38.

A highly reflective surface member 45, such as a strip of white pigmented or vacuum metalized plastic is secured on the bar face 34 so that it extends between the lamp tube and the bar face 34 for the full length of the lamp tube 32.

At the end where the most space is provided on the bar 30, a ballast 46 and a starter holder 48 are mounted on the bar 30 to project from the same face 34 as the lamp tube. A starter 50 is removably mounted on the starter holder 48. The starter, ballast and lamp holders are electrically wired using a wiring harness 52 that ends in a standard three lead cable 54. Screws 56 or the like may be used to mount the starter holder, ballast and lamp holder housings on the bar 30. The reflector 45 may be adhered to the bar face 34.

The fixture 10 further includes a lamp tube housing 58, including a packing end cap 60, a tubular lamp tube protector sleeve 62 and an inspection end cap 64, and additional parts to be described.

The packing end cap 60 has a disk-shaped end wall 66 with a central opening 68. The cable 54 passes out through the opening 68. Packing of asbestos 70 or the like and an insulating washer e.g. of a Micarta laminate 72 are placed around the cable 54 in the opening 68 and a packing tube 74 slid in over the cable 54 to engage the packing. The outer portion of the opening 68 is internally threaded. An exteriorly threaded tubular gland nut 76 is slid in over the cable and packing tube 74, and threaded into the opening 68 to longitudinally compress and radially expand and thus activate the packing.

An elastomeric washer-like bushing 77 is secured with adhesive on the inner face of the end cap 60 surrounding the opening 68.

By preference, a second opening 68 is provided through the end cap 60 beside the one just described, and closed with a threaded plug 78.

In the instance shown, the gland nut 76 and the blind plug 78 each have hex heads 80. A tapped socket 82 is provided in the cap 60 between the nut 76 and plug 78 so that the longitudinal axes of the two openings 68 and the socket 82 form a triangle. In order to prevent unintended loosening of the gland nut and blind plug, a square figured locking lug 79 is placed with two adjacent lands 81 against corresponding flats of the hex heads 80 and a screw 83 is fastened through the locking lug 79 into the tapped socket 82. Accordingly, after the end cap 60 is assembled with the cable and packing, the heads 80 cannot be turned unless the locking lug 79 is first removed.

The end cap 60 undergoes a reduction in external diameter at 84 as it proceeds axially inwards, to provide an axially inwardly facing annular shoulder 86 and an outer peripheral surface 88 that is cylindrically curved.

An axially inwardly extending tubular skirt 90 is formed on the cap end wall 66. The peripheral surface 88 continues along the outside of that skirt. Part way along the surface 88, a radially outwardly opening circumferentially extending groove 91 is formed therein as a locking screw seat. The skirt is internally threaded at 92.

The inspection end cap 64 is similar to the cap 60, except that it preferably has no openings through its end wall, no bushing 77, no cable passing therethrough and no packing therefore. Corresponding parts are given like numbering. The larger diameter axially outer portion 94 of the peripheral surface of the cap 64 is preferably provided with a plurality of angularly spaced, radially outwardly opening sockets to receive a tool (not shown) for rotating the cap 64 in a sense to tighten and loosen it with respect to the protector sleeve 62.

The lamp tube protector sleeve 62 is made of a transparent, shatter proof material, such as Lexan polycarbonate resin. It is exteriorly threaded at 96, adjacent each end.

To further assemble the fixture 10, the sleeve 62 is threaded into the end cap 60 with the lamp/bar assembly 14 enclosed by the sleeve 62. One end of the bar 30 abuts the end wall of the end cap 60.

An O-ring 98 is slipped along the surface 88 until it nestles in a slight circumferential recess 100 formed at the base of the shoulder 86.

What has been assembled so far is slid into the cage 24 through the end 102. An O-ring 98 is likewise installed on the inspection end cap 64, and the cap 64 is screwed onto the opposite end of the sleeve 62.

It should now be noticed that the two end cap skirt surfaces 88 are respectively smaller in diameter than the internal surfaces of the end supports 16 of the cage 24. Thus the end caps and all that is assembled between them are supported by the cage 24 solely via the intermediacy of the elastomeric O-rings 98. The radial clearance at 104 permits substantial misalignment and flexing of the cage while continuing to mechanically isolate the mount assembly 12 from the remainder of the fixture 10.

Note also that when the end cap 64 is fully screwed home, the nearest end of the bar 30 contacts the inside of the end wall of the end cap 64.

Screws 106 are threaded into the respective openings 20 and projected into the grooves 91 to prevent accidental disassembly.

Before the end cap 64 is finally tightened its last half turn or so, the whole structure 108 (aside from the support assembly 12) is rotated angularly to such an extent as will orient the reflector 45 at the desired position relative to the mounting bar feet 26. Thus the reflector angle relative to the mounting means 26 is infinitely variable until the end cap 64 is fully tightened.

It should now be apparent that the fluorescent mine lighting fixture as described hereinabove, possesses each of the attributes set forth in the specification under the heading "Summary of the Invention" hereinbefore. Because the fluorescent mine lighting fixture can be modified to some extent without departing from the principles of the invention as they have been outlined and explained in this specification, the present invention should be understood as encompassing all such modifications as are within the spirit and scope of the following claims.

What is claimed is:

1. A fluorescent mine lighting fixture, comprising:

a mount assembly including two coaxially alignable tubular end supports having respective throughbores and means for securing each end support to a structure to support said fixture from that structure;

a bar;

two lamp holders mounted in longitudinally spaced, opposing relation on the bar, for mounting a fluorescent lamp tube therebetween;

an electrical cable; circuit means electrically connecting the electrical cable to the respective lamp holders;

a tubular body of transparent, shatterproof material surrounding the bar;

a first end cap secured on one end of said tubular body;

means defining an opening through said first end cap, said electrical cable passing out of said tubular body through this opening;

packing means between the cable and the last-mentioned opening providing sealing therebetween;

a first elastomeric mechanical shock isolator interposed between the first end cap and one of said end supports;

the tubular body being inserted in the throughbores of the end supports, said one end support first, until the first elastomeric mechanical shock isolator is compressed between the first end cap and the one end support;

a second end cap removably secured on the other end of said tubular body; and a second elastomeric mechanical shock isolator interposed between the second end cap and the other end support.

2. The fixture of claim 1, further comprising:

a fluorescent lamp tube having two opposite ends with contact pins projecting therefrom;

an elastomeric bushing carried on each end of the fluorescent lamp tube, with said pins projecting therepast;

the ends of the fluorescent lamp tube being mounted in the respective lamp holders with said elastomeric bushings interposed therebetween as mechanical shock isolators.

3. The fixture of claim 1, further comprising:

a plurality of longitudinally extending, parallel rods angularly spaced from one another and secured to each of said two end supports to unite the two end supports therewith to provide a cage.

4. The fixture of claim 1, further comprising:

a light reflector mounted on said bar and extending substantially the whole way between the two lamp holders.

5. The fixture of claim 4 wherein: the reflector is a strip of light reflective plastic material adhered to the bar.

6. The fixture of claim 4, wherein:

until the second end cap is tightly secured on said other end of the tubular body, the first end cap and thus the bar, and reflector are angularly rotatable about the longitudinal axis of the first end cap for selectively positioning the reflector relative to said means for securing the end supports to a structure, whereby once a selected angular position for the reflector has been achieved, the second end cap may be tightly secured to maintain that selected angular position.

7. The fixture of claim 1, wherein:

each end cap includes an end wall having a tubular skirt projecting axially inwardly from said end wall thereof;

means defining a band of helical threading on said tubular body adjacent each end thereof;

means defining cooperating helical threading on each end cap;

the end caps being secured on respective ends of said tubular body by being threadably connected via said helical threading.

8. The fixture of claim 7, wherein:

each skirt has means defining a radially outwardly opening groove therein and each end support has means defining a radially directed, tapped opening therethrough; a set screw being threaded in each said tapped opening and projecting into the respective groove to prevent disassembly of the end caps from the end supports for so long as the set screws remain so projected.

9. The fixture of claim 1, wherein:

said circuit means incorporates a ballast and a starter support secured on said bar axially beyond the lamp supports; and a starter mounted on said starter support.

10. The fixture of claim 9, further comprising:

a plurality of longitudinally extending, parallel rods angularly spaced from one another and secured to each of said two end supports to unite the two end supports therewith to provide a cage;

the means for securing each end support to a structure comprising: a bar foot applied tangentially against the respective end support and two angularly adjacent ones of said rods and secured thereto; and means defining bolt holes through said bar feet.

* * * * *